United States Patent [19]

Araya

[11] 3,969,889

[45] July 20, 1976

[54] METHOD OF MANUFACTURING STEPPED BUSHINGS FOR CHAINS

[76] Inventor: Kumakichi Araya, No. 2, Daishoji Seki, Kaga, Ishikawa, Japan

[22] Filed: Oct. 24, 1974

[21] Appl. No.: 517,609

[30] Foreign Application Priority Data

Oct. 31, 1973 Japan ..... 48-121683
Dec. 12, 1973 Japan ..... 48-137630

[52] U.S. Cl. ..... 59/8; 72/108
[51] Int. Cl.[2] ..... B21L 9/02
[58] Field of Search ..... 59/8, 30, 35, 78, 84; 29/149.5 R, 149.5 C, 149.5 DP; 72/107, 108, 256, 348

[56] References Cited

UNITED STATES PATENTS

| | | | |
|---|---|---|---|
| 2,126,893 | 8/1938 | Klamp | 29/149.5 R |
| 2,126,912 | 8/1938 | Murden | 29/149.5 R |
| 2,944,450 | 7/1960 | Moeltzner et al. | 72/108 |
| 3,052,278 | 9/1962 | Baluck et al. | 72/108 |
| 3,426,522 | 2/1969 | Onulak | 59/8 |
| 3,434,322 | 3/1969 | Cowles et al. | 72/107 |
| 3,498,095 | 3/1970 | Marcouitch | 72/107 X |

FOREIGN PATENTS OR APPLICATIONS

| | | | |
|---|---|---|---|
| 14,969 | 11/1886 | United Kingdom | 59/35 |

*Primary Examiner*—C.W. Lanham
*Assistant Examiner*—Gene P. Crosby
*Attorney, Agent, or Firm*—Stevens, Davis, Miller & Mosher

[57] ABSTRACT

A method of manufacturing stepped bushings for chains characterized in that opposite ends of a cylindrical bushing blank body are formed into reduced diameter portions by application of roll pressure and form rolling.

3 Claims, 12 Drawing Figures

METHOD OF MANUFACTURING STEPPED BUSHINGS FOR CHAINS

DESCRIPTION OF THE PRIOR ART

In a conventional method, which has been known as a wound bushing, used to manufacture stepped bushings for roller chains, bushed chains, and the like, both side edges of a lengthy steel band 1 having a predetermined width are rolled, as shown in FIG. 1, by a rolling mill not shown to form stepped parts 2, 2 into a blank T, which is then cut off by a press into predetermined dimensions parallel to line l—l, after which the blank pieces thus cut are wound by a series of rolls in such a manner that edges thereof are joined with each other to provide a stepped bushing A having a lengthwise seam 3 and formed with a central portion $a_1$, and reduced diameter portions $a_2$ and $a_2$, as shown in FIG. 2. This method of manufacturing the stepped bushing A poses various drawbacks such that when the blank is wound by the rolls to form a tubular body, a true circularity is difficult to achieve, if the blank is excessively wound by the rolls, a clearance tends to be formed at seam 3 in central portion $a_1$ due to the difference of elongation between the central portion $a_1$ and the reduced diameter portion $a_2$. Even if the clearance should not be formed at seam 3, the edges are not in a completely intimate contact relationship with each other since the seam itself has rupture surfaces created by cutting the blank T by a press. Thus the stepped bushing A fitted with an interference allowed in a roller link plate may be fastened at the reduced diameter portions $a_2$ and $a_2$ and as a consequence seam 3 is contracted to thereby tend to form a clearance at seam 3 in the central portion $a_1$ and to render the central portion $a_1$ into a shape just like a drum. In addition to the above method, there have been employed two additional manufacturing methods. One is such that a lengthy steel band having a predetermined width is worked into a flattened form, which is then subjected to blanking and drawing, and then a cup-shaped blank thus obtained will have its bottom blanked to form a cylindrical body. The other is such that a steel pipe is cut into predetermined dimensions, after which it is formed as provided with reduced diameter portions to provide a stepped bushing. That is, in the event that the blanking and drawing processes as described in the former method (I) are used to form a cylindrical bushing blank body B as shown in FIG. 3, irregular lugs are created at one edge of the cup blank body, and as a result, it is difficult for the body to be received in the roller link plate unless the lugs are crushed by a press or cut off and acute portions at extreme outer peripheral edges 4, 4 are removed. Further, in the event that the manufacture of stepped bushings with the use of a steel pipe as described in the latter method (II) is used, it is necessary to remove "burr", created at the time of cutting which remain on the extreme inner peripheral edges 5, 5 as well as the above-mentioned acute portions at the extreme outer peripheral edges 4, 4. For this reason, either method as described above possesses various disadvantages in terms of mass production. Further, in the case of this bushing blank body B, when the opposite ends thereof are mechanically cut so as to form a stepped bushing C comprising a central portion $c_1$, reduced diameter portions $c_2$ and $c_2$ as shown in FIG. 4, a tubular body having a hole of uniform diameter and an outer peripheral edge of approximately uniform diameter is formed.

However, when the reduced diameter portions $c_2$, $c_2$ of the stepped bushing C are fitted into holes 7, 7 in the roller link plates 6, 6, respectively, the tighter the interference, the inside diameter of the stepped bushing C becomes compressed by the reduced diameter portions $c_2$ and $c_2$ to render the tubular body into a contracted tube. The degree of this contraction varies depending on the interference, but is in the range of ⅛ to ⅜ of the interference in general. In this condition, the central portion $c_1$ has its inside diameter uncontracted and thus, when the tube is observed on an enlarged scale, it looks like a "drum" whose opposite ends are narrow with an inflated central portion. This fact is recognized by the presence of an initial elongation of chains, which represents the phenomenon remarkably. When a pin, not shown, of uniform diameter is inserted into the stepped bushing C, the contact of the pin with the internal peripheral surfaces of the stepped bushing C is not uniform but the partial contact is made at the opposite ends so that a partial load may be applied to cause the pin and the bushing to constitute a bearing portion. In addition, when the bushing is engaged with a chain wheel to effect power transmission, bending occurs at the bearing portion at a certain angle to thereby produce local friction and wear at the bearing portion. Thus, in the case of a series of lengthy members connected by a number of bearing portions such as chains, accumulation of minor wear produced at the bearing portion leads to a great wear that cannot be ignored, which represents a series of elongations. Consequently, if the chain uses "drum-like" bushings an initial elongation thereof is remarkably great so as to produce the elongation of the chain until the pin and the bushing are brought into a smooth contacting relationship with each other, thus placing it in unstabilized condition.

In a conventional method of fabricating the stepped bushing C, mechanical cutting is used to form a reduced diameter portion $c_2$. As a result, disposal of chips of a material caused by cutting is necessary. In cutting it is not always possible to maintain preciseness and cutting surfaces in a uniform condition so that at least one portion of the stepped bushing C is necessarily altered even if a chain is of small type. This makes it difficult to reduce cost. Referring now to the cutting surfaces as just mentioned, a most handy means used to form a reduced diameter portion in the bushing blank body B comprises the step of holding the bushing blank body B on a lathe to cut it while being whirled. Cutting of the body B should be carried out so as to form a central portion $c_1$ having a predetermined length in order that the reduced diameter portion may be firmly fitted in the hole 7 in the roller link plate 6, and that a position of the reduced diameter portion to be placed under pressure in the roller link plate 6 to create a uniform space between the roller link plates 6 and 6. If, at the time of cutting, the width of the central portion $c_1$ is not uniform, the engagement thereof with the chain wheel becomes poor and the inner surfaces of the roller link plates 6, 6 may be scraped by the chain wheel. Commonly, the stepped bushing C is subjected to heat treatment such as hardening, tempering, etc. to make it harder than the quality of the roller link plate 6. Microscopically, the surface finished by cutting has thereon numerous concave and convex stripe marks. The stripe marks are present at a right angle to the fitting direction with respect to the roller link plate 6 and often are harder and more brittle than the material of the stepped bushing C. The stripe marks scrape the inner surfaces of the hole 7 to pose a state different from that of the fitting at the outset and hence, vibration and migration, which are abnormal, occur due to the chain wheel being engaged and driven. Thus, inevitably, inching is made on the side of a pin link plate (not shown) in the direction opposite to that fitted with the roller link plate 6, resulting in a worse fit between the roller link plate 6 and the reduced diameter portion $c_2$, and a rotation of the stepped bushing causes the hole 7 to be worn. As for the chain held from both outer sides by means of a pin (not shown) clamped by the pin link plate, the roller link plate 6 is not entirely separated from the stepped bushing C, thereby decreasing its function as a chain and assembling greatly decreases. The vibration and migration abnormally increase to thereby further increase noises. For this reason the relationship of parts at the time of fitting is not always set to a predetermined standard value but is often set experimentally or through the conditions of use. Unless the outer peripheral edge of the reduced diameter portion $c_2$ of the stepped bushing C is chamfered, the bushing is difficult to be fitted into the hole 7 of the roller link plate 6. Moreover, the bushing blank body B has a great variety of sizes including one having 5 mm outside diameter and 10 mm length, and cutting the reduced diameter portion $c_2$ requires much time and labor. Accordingly, the foregoing method does not serve as a satisfactory method of manufacturing stepped bushings. It will be noted that a roller 8 is rotatably received in the central portion $c_1$.

SUMMARY OF THE INVENTION

This invention has a first feature wherein band steel or bar steel is worked to form a cylindrical bushing blank body and a pin is inserted into said bushing blank body to form an integral member. Opposite ends of the bushing blank body are applied with pressure and form rolled with the pin serving as a mandrel by a pair of rolls so as to form reduced diameter portions thereby providng a stepped bushing of a desired shape. A second feature lies where pins and bushing blank bodies are received and supported within concavities made in a pair of discs which simultaneously and intermittently rotate through a partition wall formed with a through hole, after which the pin and the bushing blank body are integrally formed by a pusher. The discs are then rotated and stopped to guide the integral member along a guide channel. Thereafter, a pair of holders is moved to hold and work the integral member between said pair of rolls to form reduced diameter portions at the opposite ends of the bushing blank body thereby providing a stepped bushing of a desired shape.

It is a principal object of this invention to provide a method of manufacturing stepped bushings for chains, wherein bushings, particularly stepped bushings for chains may continuously be worked with a uniform quality, an increased preciseness in dimension and within a space of time.

It is another object of this invention to provide a method of manufacturing stepped bushings for chains, wherein a bushing may be fitted into a roller link plate firmly and readily to withstand long use.

DETAILED DESCRIPTION OF THE PREFERRED EMBODIMENTS

Figure 6:
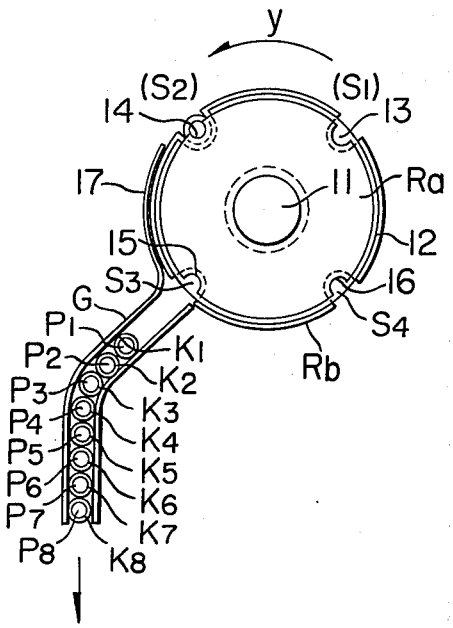
FIG. 6 is a fragmentary elevational view of a shaping device.
Figure 7:
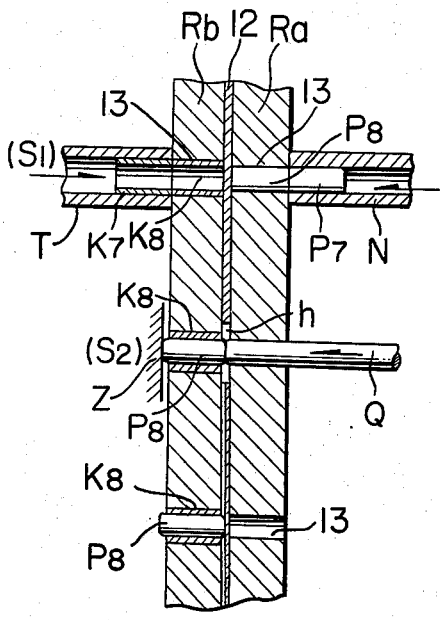
FIG. 7 is a sectional view of a principal part of a disc in FIG. 6 developed lengthwise.
Figure 12:
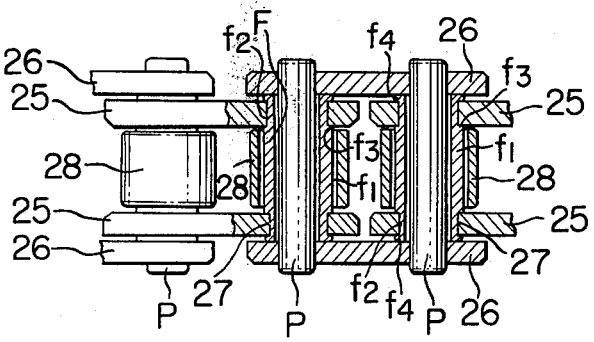
FIG. 12 is a longitudinal sectional view of a principal part partly cutaway incorporating therein the stepped bushing of FIG. 10.

Referring now to FIGS. 6 and 12 to describe devices required for developing the present invention, there is shown a so-called intermittently rotating shaft 11 adapted to repeat rotation and stop through an intermediate drive body such as a barrel cam (not shown). The shaft is driven by a suitable prime mover such as a motor, engine or the like. Discs $R_a$, $R_b$ defined and arranged in parallel through a partition wall 12 are secured to the rotating shaft 11. Concavities 13, 14, 15 and 16 are uniformly positioned along the outer peripheral edges of the discs $R_a$ and $R_b$. In the first stage $S_1$, guides N and T are mounted on opposite sides (to the right and left as viewed in FIG. 7) of the discs. In the second stage $S_2$, a through hole $h$ is formed in the partition wall 12 and a stop wall $z$ is provided close to the disc $R_b$. An arcuate guide plate 17 is provided along the outside of the outer peripheral edges of the discs $R_a$ and $R_b$ between the second stage $S_2$ and the third stage $S_3$ to prevent members received in the aforesaid concavities 13, 14, 15 and 16 from being unduly disengaged. In the midst of a passage (not shown) which communicates the extremity of a bend guide channel G formed in the third stage portion with a chute not shown, a pair of upper roll 18 and lower roll 19 is opposedly arranged. The upper roll 18 and lower roll 19 have their outer peripheral edges cut and formed with contours in shape of a workpiece so that the upper roll 18 is vertically movable to press or release the workpiece held between the upper roll 18 and the lower roll 19. Between both of the rolls there is opposedly arranged a pair of holders 20 and 21 capable of coming in and out of the rolls so that tubular bodies $K_1$, $K_2$, $K_3$ . . . $K_8$ and pins $P_1$, $P_2$, $P_3$ . . . $P_8$ taken out of the guide channel G may be pushed by, for example, the holder 20 in between the upper roll 18 and the lower roll 19. Further, the holders 20 and 21 have their extremities provided with pin supports $u_1$, $u_2$ and tubular body supports $v_1$, $v_2$ so as to prevent, in operation, the workpiece from being unduly moved. It will be noted that in driving each of the above-described discs $R_a$, $R_b$, the upper roll 18, and the holders 20, 21 are remotely controlled through limit switches and relays not shown is synchronism with a predetermined phase difference. A pusher Q is provided which is capable of being moved in and out on the disc $R_a$ side in the second stage $S_2$ so as to press and hold the workpiece against the stop wall Z. The concavity 16 is one formed in reserve, and normally, three concavities 13, 14, and 15 will suffice to form desired bushings.

Figure 8:
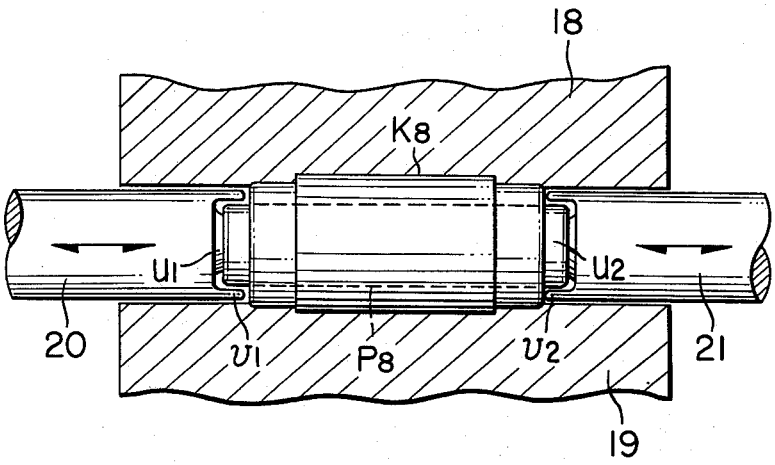
FIG. 8 is a longitudinal sectional view of a principal part of rolls for application of form rolling to a bushing.
Figure 9:
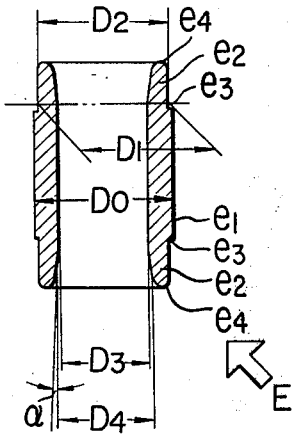
FIG. 9 is a longitudinal sectional view of a stepped bushing in accordance with the present invention.

From the above-mentioned construction of the invention, in the manufacture of stepped bushings, when the rotating shaft 11 is rotated by means of a prime mover in the direction as indicated by the arrow *y* (counterclockwise) in FIG. 6 and initially stopped the discs $R_a$ and $R_b$ at the first stage $S_1$, pin $P_8$ and tubular body $K_8$ are pressed and inserted into the concavities 13 and 13 on the opposite sides of the partition wall 12 by means of pusher members not shown in the direction as indicated by the arrows through the guides N and T. After rotating further shaft 11 the pin and tubular body reach the second stage $S_2$ where pusher Q, which has been on the disc $R_a$ side, moves forward in the direction as indicated by the arrow to push the pin $P_8$ through a hole *h* in the partition wall 12 into the tubular body $K_8$ supported on the disc $R_b$ side. When pin $P_8$ is pushed by pusher Q pin $P_8$ is integrally received and properly positioned in the tubular body $K_8$ due to stop wall Z. Then, after pusher Q is withdrawn from disc $R_a$, shaft 11 is again rotated in the direction towards the third stage $S_3$. Integral members pin $P_8$ and tubular body $K_8$ are conveyed to third stage $S_3$ while being held within concavity 13 of disc $R_b$ with the aid of guide plate 17 until they stop at the third stage $S_3$, at which time the integral members are disengaged from concavity 13 which is now positioned at concavity 15 in FIG. 6. The integral members are dropped by gravity towards the guide channel G. The members thus dropped successively accumulate within the guide channel G and are then conveyed to a position set between the upper roll 18 and the lower roll 19 through a guide passage (not shown) like a chute. When the upper roll 18 is positioned above the position shown in FIG. 8, the holders 20 and 21 urge the integral members of pin $P_8$ and tubular body $K_8$ to a predetermined position on lower roll 19 (in a mid-position in the drawing) so that the opposite ends of pin $P_8$ and tubular body $K_8$ may be supported by pin supports $u_1$, $u_2$ and tubular body supports $v_1$, $v_2$ to hold them in a predetermined position, after which the upper roll 18 is moved down and set in a position as shown. Holders 20 and 21 then are slightly withdrawn to allow pin $P_8$ and tubular body $K_8$ to be placed in a slidable and rolling condition, whereby the upper roll 18 may be rotated to bear against the lower roll 19 to form stepped parts in the outer peripheral edge of the tubular body $K_8$ with pin $P_8$ as a mandrel. This operation provided a stepped bushing E as shown in FIG. 9, by form rolling. Upon completion of the form rolling, the upper roll 18 is moved upwardly to release the tubular body K and holders 20 and 21 are withdrawn so that stepped bushing E along with pin $P_8$ is naturally dropped by the small inertia rotation of lower roll 19. In this manner, the foregoing processes may be repeated to continuously and automatically mass produce stepped bushings, which are uniform in quality.

Although the tubular body $K_8$ and pin $P_8$ may be inserted in between upper roll 18 and lower roll 19 instead of holding them by holders 20 and 21 are unidirectionally pushed out at the lowermost end of the guide channel G, the holders 20 and 21 are used so that tubular body $K_8$ and pin $P_8$, may accurately be inserted and set between the rolls. Moreover, bushings which are of good uniform quality may be obtained since the workpiece is not unduly displaced during operation due to shocks or vibration occurring in and between members.

Figure 11:
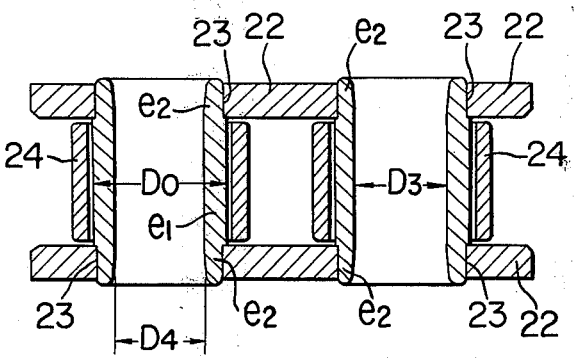
FIG. 11 is a longitudinal sectional view of a roller link incorporating therein the stepped bushing of FIG. 9.

In accordance with the present invention, tubular bodies $K_8$, $K_7$ . . . shaped like, for example, the bushing blank body B made of band steel or bar steel are inserted to roll them with the pins $P_8$, $P_7$ . . . as mandrels, and accordingly, the stepped bushing E with a central portion $e_1$ and reduced diameter portions $e_2$ and $e_2$ as shown in FIG. 9 may be formed with uniform dimensions, $D_3$, so as to register with the outside diameter of the pin to be inserted. The quality may be readily maintained since the pins are the same in size as those required in assembling chains. A clearance between the inside diameter of the bushing and the outer peripheral surface of the pin may be assured to maintain true circularity and accuracy in the dimension of the bushing. The outside diameter $D_0$ is the same as the outside diameter of the tubular body. The outside diameter $D_2$ of the extreme outer peripheral edge $e_4$ is greater than the outside diameter $D_1$ in the vicinity of the stepped part $e_3$, the difference between $D_1$ and $D_2$ being more or less about ⅛ to ⅜ of the interference. The difference between the inside diameter $D_3$ in the vicinity of the stepped part $e_3$ and the inside diameter $D_4$ of the extreme outer peripheral edge $e_4$ is the same as $(D_1-D_2)$. The angle of enlargement $\alpha$ formed at the extreme outer peripheral edge $e_4$ is about 1° to 2° (this enlargement phenomenon is hereinafter referred to as "restitution"). When the reduced diameter portion $e_2$ of the stepped bushing E thus produced is fitted into a hole 23 in a roller link plate 22 shown in FIG. 11 by application of an interference, the distance between the roller link plates 22 and 22 may be maintained constant by the presence of the stepped part $e_3$. To strongly press the inner peripheral surfaces of the hole 23 with the aid of strength of stability in the reduced diameter portion $e_2$ a fit is created which is much stronger than is obtained by the prior art. The extreme outer peripheral edge $e_4$ may receive a tighter fit, whereby a chain formed with the stepped bushings may have, in use, a uniform and wide area of contact with pins and as a result may run smoothly and safely. Rollers 24 are disposed in idling relationship with the outer peripheral edges of the central portion $e_1$.

Figure 1:
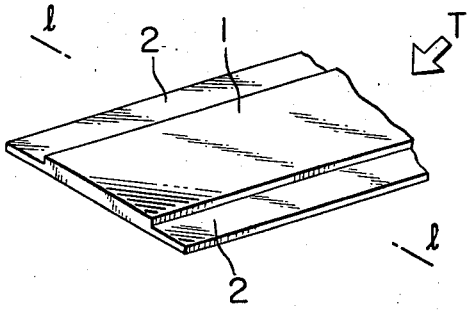
FIG. 1 PRIOR ART
FIG. 1 is a perspective view of a wound bushing blank in accordance with the prior art.
Figure 2:
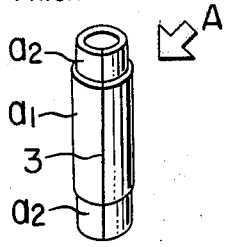
FIG. 2 PRIOR ART
FIG. 2 is a perspective view of a wound bushing formed by the wound bushing blank shown in FIG. 1.
Figure 3:
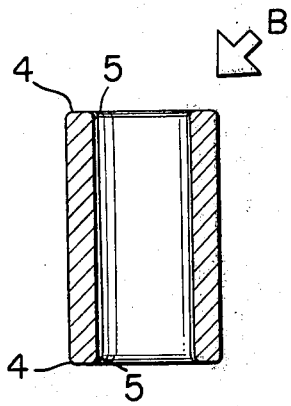
FIG. 3 is a longitudinal sectional view of a bushing blank body.
Figure 4:
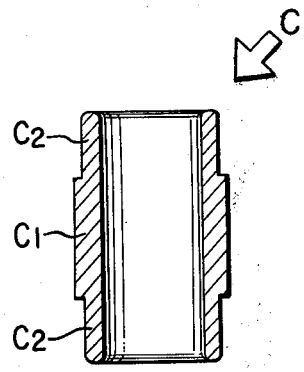
FIG. 4 is a longitudinal sectional view of a conventional stepped bushing.
Figure 5:
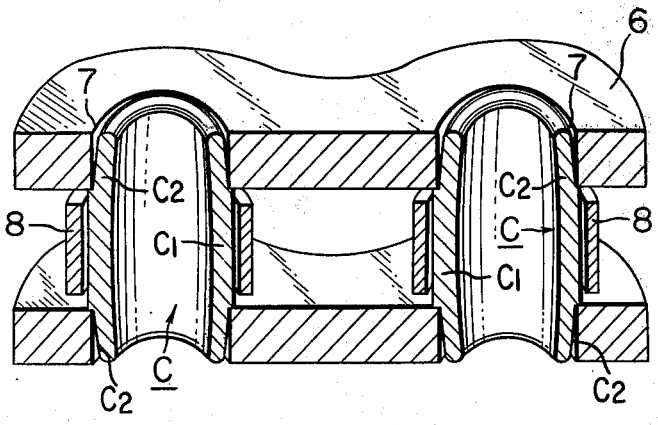
FIG. 5 is a perspective view in longitudinal section of a roller link incorporating therein the stepped bushing of FIG. 4.
Figure 10:
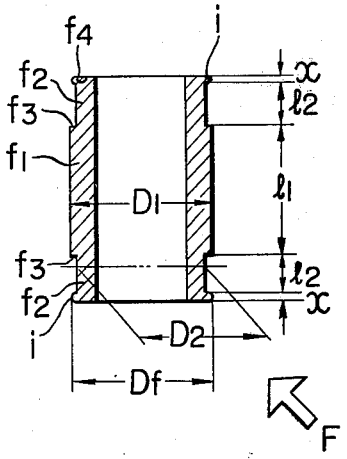
FIG. 10 is a longitudinal sectional view of another embodiment of the stepped bushing in accordance with the present invention.

Referring now to FIGS. 10 and 12 in which a second embodiment is illustrated in the form of a stepped bushing F, a tubular body having the shape like the bushing blank body B as shown in FIG. 3 is subjected to application of pressure and form rolling between the upper roll 18 and the lower roll 19 to form a central portion $f_1$ and reduced diameter portions $f_2$ and $f_2$. Stepped parts $f_3$ and $f_3$ are formed so that the distance between roller link plates 25 and 25 may be made constant when the aforesaid reduced diameter portions $f_2$ and $f_2$ are fitted into the roller link plates 25 and 25, and flange portions *i* are formed in the extreme outer peripheral edges $f_4$ and $f_4$. The length $l_1$ and diameter $D_1$ of the central portion $f_1$, and the diameter $D_2$ of the reduced diameter portion $f_2$ have the same dimension as those of the prior art, and the length $l_2$ of the reduced diameter portion $f_2$ is the same as or slightly shorter than the thickness of the roller link plate 25. The thickness *x* of the flange portion *i* at the extreme outer peripheral edge $f_4$ is determined depending upon the clearance between the pin link plate 26 and the roller link plate 25 but is generally more or less 0.3 to 0.6 mm, which is determined according to the length of the chain. The diameter $D_f$ at the extreme outer peripheral edge $f_4$ is made greater than the diameter $D_1$ by the portion of the interference in the diameter $D_1$. When the stepped bushing F thus dimensioned is placed under pressure by means of a press into a hole 27 of the roller link plate 25, a part of the flange portion *i* is slightly contracted and simultaneously urged into the roller link plate 25 side. When partly forced out with respect to the direction being placed under pressure, the stepped bushing F itself tends to return, by action of elasticity, to its initial magnitude and as a result, the forced out extreme outer peripheral edge $f_4$ of the flange portion *i* presses the peripheral edge of the hole 27 and determines the fitting position of the roller link plate 25 in cooperation with the stepped part $f_3$ so as to press the extreme outer peripheral edge of the hole 27 in the roller link plate 25 thereby preventing outward disengagement of the roller link plate 25. Pressing of the extreme outer peripheral edge of the hole 27 as mentioned above is due to the restitution similar to the case as in the stepped bushing E previously discussed. In accordance with the fitting system as just mentioned, there is obtained the effect similar to that as obtained by a conventional system wherein caulking or caulking-fixing is applied to the extreme peripheral edge of the bushing. When pressure is applied, smooth central portion $f_1$, reduced diameter portion $f_2$, and flange portion *i* in the stepped bushing F may principally be formed. As a consequence, it is only required to increase the magnitude of pressure at the time of fitting and hence the assembling step becomes easy. In order to prevent the flange portion *i* from being excessively projected from the roller link plate 25, chamfering may be applied on the projected side so as to vary the length $l_2$ of the reduced diameter portion $f_2$. The reference character P denotes a pin, and 28 a roller.

The present invention possesses various advantages, first, stepped bushings having a uniform quality, specification and predetermined dimension at every part may be mass-produced continuously and easily; secondly, stepped bushings according to the invention produce no stripe marks particularly in their reduced diameter portion to thus provide a smooth surface finish since the method of the invention is different from a conventional method wherein bushing is formed by partly cutting a tubular body, and to provide better appearance, and in addition require no disposal of chips of materials and avoid waste of materials; thirdly, the pin is inserted into a tubular body, outer peripheral surface of which is subjected to form rolling by means of a pair of rolls so that "restitution" is created from the base of the stepped part to the edge portion, and for this reason, the pin may receive form rolling together with the tubular body due to the presence of the interference allowed at the time of fitting, thus providing better registration between the inner surfaces of the stepped bushing and the outer peripheral surfaces of the pin; fourthly, stepped bushings with the spherical portion may be continuously finished by the provision of rolls cut and formed therein with concave and convex configurations; fifthly, the aforementioned "restitution" causes the reduced diameter portion to be restored towards the peripheral edge of the hole in the roller link plate, the elasticity thereof rendering a firm bonding between the reduced diameter portion and the peripheral edge of the hole; and sixthly, since stepped bushings are formed by application of form rolling, the extreme outer peripheral edges thereof may be chamfered simultaneously as well as formation of spherical portions, and particularly when a tubular bushing blank body is obtained by bottom blanking after a cup has been formed by blanking, drawing or extrusion, lugs produced in the extreme peripheral edges of the cup or pointed portions such as knife edges produced in the peripheral edges of the lugs may be touched by properly to thereby provide better exterior appearance, to make easy fit into the roller link plate, and to maintain a firm bonding condition, and from this reason, the chain thus obtained may perform its function for a long period and may be used by operators safely in addition to economical merits.

From a manufacturer's viewpoint, since the reduced diameter portions may be formed continuously, the result will be a considerable reduction in time and labor required for production per unit. The mass production system may be employed to create uniform quality and at reduced cost. In addition, when the spherical portion is formed at the extreme outer peripheral edge of the reduced diameter portion, it is fitted into the roller link plate, to form a firm and stabilized fit similar to caulking, caulking-fixing, or the like. This fit may be maintained to avoid occurrence of cracks or damage likely given to the bushing itself due to the difference of strength used when fitting is accomplished by interference or required for caulking or caulking-fixing. On the other hand, when bushings of a small diameter are desired, the bushing may be fitted with the roller link plate sufficiently firm. In the event that a press blanking is used for mass production, undue waste of materials may also be avoided.

From the foregoing description relating to the construction and manufacture of the stepped bushing in accordance with the present invention, it will be appreciated that the fit between the bushing and the roller link plate may be made tighter than is obtained heretofore and may be maintained for a longer period. Wear caused by contact with the pin may be reduced considerably and as a result, undue rocking and migration likely to occur when the chain is driven may be properly avoided to thereby provide safe running and long service life. Further it provides economic merit.

What is claimed is:

1. A method of manufacturing a stepped bushing having two portions extending beyond a central portion of lesser diameter than the central portion comprising forming a cylindrical bushing blank body of a predetermined length, inserting a pin of substantially the diameter of the interior of the body into said body, applying pressure and form rolling by grooved rolls, said blank body to form a stepped bushing with the outside diameters in the extreme outer peripheral edges of the reduced diameter portions greater in diameter than the outside diameter at the juncture with the central portion, the interior diameter of the bushing at the outer peripheral edge being greater in diameter than the interior diameter of the bushing at the juncture with the central portion, the extreme outer edge of the bushing having an angle of enlargement with the interior of the bushing at the outer edge of from 1 to 2 degrees.

2. The method of manufacturing stepped bushings in accordance with claim 1 including inserting pins and cylindrical bushing blank bodies by means of pushers into concavities in a pair of simultaneously rotatable discs disposed on either side of a partition wall having a through hole, rotating said discs until the through hole is aligned with said concavities, inserting said pin into said blank body, rotating said discs until a guide channel is reached whereby said blank bodies with pins therein are dropped from said discs and form rolled.

3. A method of manufacturing a stepped bushing having two portions extending beyond a central portion of lesser diameter than the central portion comprising forming a cylindrical bushing blank body of a predetermined length, inserting a pin of substantially the diameter of the interior of the body into said body, applying pressure and form rolling by grooved rolls, said blank body to form a stepped bushing with the outside diameters in the extreme outer peripheral edges of the reduced diameter portions greater in diameter than the outside diameter at the juncture with the central portion, the interior diameter of the bushing at the outer peripheral edge being greater in diameter than the interior diameter of the bushing at the juncture with the central portion, said grooved rolls create flanges on the outer peripheral edges of the reduced diameter portions, said flanges having a width lengthwise of said bushing of from 0.3 to 0.6 mm.

* * * * *